United States Patent [19]

Mattson

[11] Patent Number: 4,754,580

[45] Date of Patent: Jul. 5, 1988

[54] SURFACE DRESSING APPARATUS

[75] Inventor: Harold L. Mattson, Hastings, Mich.

[73] Assignee: Floor Style Products, Inc., Hastings, Mich.

[21] Appl. No.: 899,912

[22] Filed: Aug. 25, 1986

[51] Int. Cl.[4] ..... B24B 7/18

[52] U.S. Cl. ..... 51/177; 15/49 R; 15/98

[58] Field of Search ..... 51/170 R, 170 T, 177; 15/49 R, 98

[56] References Cited

U.S. PATENT DOCUMENTS

| | | | |
|---|---|---|---|
| 877,954 | 2/1908 | Schuttler | 51/177 |
| 2,097,806 | 11/1937 | Weidrich | 51/177 |
| 2,242,229 | 5/1941 | Burleigh | 51/273 |
| 2,544,377 | 3/1951 | Cooke | 51/177 |
| 2,618,798 | 11/1952 | Ohrt | 51/177 |
| 2,662,351 | 12/1953 | Iobbi | 51/177 |
| 3,129,539 | 4/1964 | Tempero | 51/177 |
| 4,125,968 | 11/1978 | MacKey | 51/170 R |

FOREIGN PATENT DOCUMENTS

| | | | |
|---|---|---|---|
| 1289450 | 2/1969 | Fed. Rep. of Germany | 51/170 T |
| 1110553 | 10/1955 | France | 51/170 T |

*Primary Examiner*—Roscoe V. Parker
*Attorney, Agent, or Firm*—Frank J. Uxa

[57] ABSTRACT

A surface dressing machine including a housing; a motor mounted on the housing; a disc associated with the housing and being capable of rotating relative to the housing in response to the force generated by the motor, the disc including a dressing element, e.g., sandpaper, adapted to contact the surface to provide the desired dressing to the surface; and a bearing press fitted into the housing and the disc, and acting to facilitate the rotation of the disc relative to the housing.

19 Claims, 1 Drawing Sheet

FIG. 1
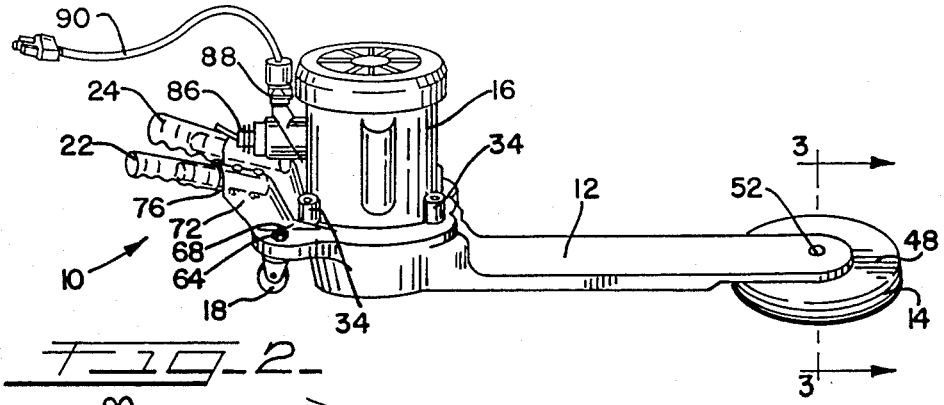
FIG. 2
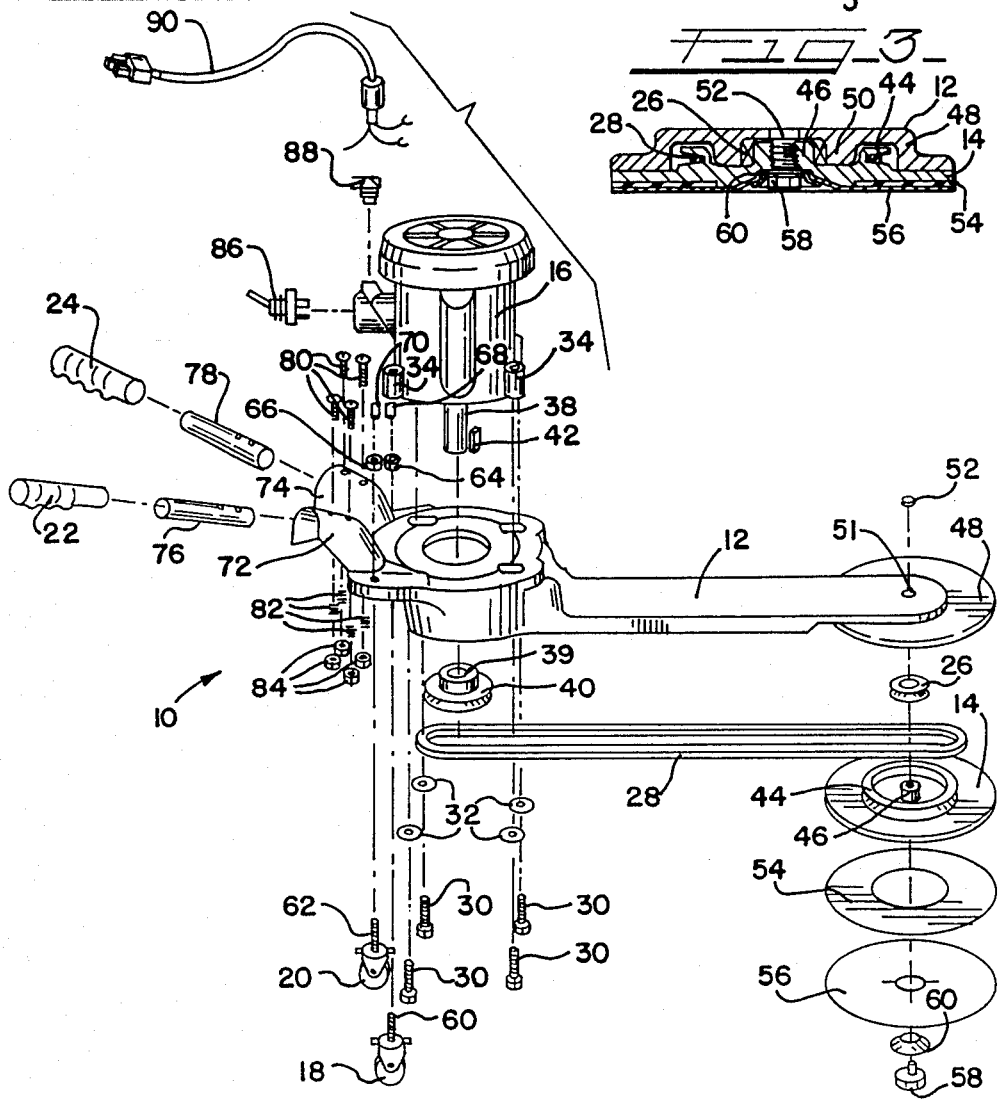
FIG. 3

SURFACE DRESSING APPARATUS

This invention relates to an improved apparatus useful for dressing surfaces. More particularly, the invention relates to an improved surface dressing machine which involves a rotating dressing element to provide the desired dressing to a surface.

The use of machines which include rotating discs to dress, e.g., sand, polish, buff and the like, floors and other surfaces is wide spread. Certain of these machines are disclosed in the following U.S. Pat. Nos. 877,954, 2,097,806; 2,618,798; 2,662,351; and 4,125,968. Many of these prior devices involve cumbersome and bulky bearing/disc arrangements, e.g., involving threading the disc on a shaft to associate the disc with the bearing, which increase the height of the device and restrict use in hard to reach locations. Also, these relatively complex bearing/disc arrangements tend to require increased maintenance. There continues to be a need for an improved surface dressing machine. For example, an improved machine which is relatively lightweight, easy to operate and manipulate into hard to reach locations and is effective to provide the desired surface dressing would clearly be advantageous.

Therefore, one object of the present invention is to provide an improved apparatus useful for dressing a surface.

Another object of the invention is to provide an improved surface dressing machine. Other objects and advantages of the present invention will become apparent hereinafter.

An apparatus useful for dressing a surface has been discovered. In one broad aspect the apparatus comprises: housing means, preferably elongated housing means, having mutually opposing first and second ends; motor means adapted to be mounted on the housing means, preferably nearer the second end of the housing means; disc means adapted to be located near the first end of the housing means and being capable of rotating relative to the housing means in response to the force, e.g., the rotational force, generated by the motor means, the disc means including a dressing element adapted to contact the surface to provide the desired dressing to the surface; force transfer means associated with both the motor means and the disc means and acting to transfer rotational force generated by the motor means to the disc means; and bearing means press fitted into the housing means and press fitted into the disc means and acting to facilitate the rotation of the disc means relative to the housing means.

The present system is effective, relatively lightweight and has extended, low profile reach for easy manipulation in heretofore hard to reach locations or spots on the surface to be dressed. For example, the housing means can be made of a single piece of lightweight material, e.g., cast aluminum. The press fitted bearing means is not only simple and effective, but also is dependable, requires reduced maintenance and, importantly, allows the entire dressing apparatus to be structured with a low profile which provides for effective surface dressing at locations which are difficult, if not impossible to properly dress using prior machines. Clearly, the elegant simplicity of the present apparatus represents a substantial advance in the art of surface dressing.

As noted above, the present housing means is preferably made from a single piece of material. Preferably, the second end of the housing means is adapted to accommodate two separate hand grips. These handgrips are preferably removably secured to the housing means. This feature allows the handgrips to be easily replaced, e.g., when they become worn, without disturbing the remainder of the apparatus. The highest point on the handgrips is preferably less than about 12 inches, more preferably less than about 6 inches, in vertical distance from the bottom of the housing means. This preferred configuration has been found to provide the human operator of the present apparatus with improved control of the rotating dressing element relative to, for example, many of the prior devices with upwardly extending handles.

The present apparatus preferably further comprises at least two, more preferably two, wheels or casters located near the second end of the housing means. These casters are rotatable relative to the housing means and are capable of contacting the surface to facilitate the movement of the apparatus on the surface being dressed. More preferably, these casters are structured so that the position of the casters relative to the housing means is adjustable so that the distance between the second end of the housing means and the surface when the casters contact the surface is adjustable. This more preferred feature allows the apparatus to be positioned to suit the comfort of the individual operator of the apparatus. In addition, the casters can be adjusted to minimize the vertical distance between the housing means and the surface being dressed, thereby still further increasing the "reach" of the present apparatus.

The motor means of the present system may be any suitable force generator. Preferably, the motor means is structured to be powered by electricity, e.g., a conventional electric motor. The motor means preferably includes a pulley or like element secured to the power shaft of motor means to facilitate the transfer of rotational force from the motor means to the disc means. The force transfer means preferably comprises a continuous belt, e.g., a belt conventionally used to transfer power or force from a motor or engine to a fan or other rotating element.

The disc means preferably includes a disc with a dressing element removably mounted, more preferably threadably mounted, on the disc. The disc means preferably further includes a traction layer mounted more preferably adhesively mounted, on the disc and contacting the dressing element. This traction layer acts to facilitate rotation of the dressing element in response to rotation of the disc.

The dressing element may be any suitable element which by rotating in contact with the surface imparts the desired dressing to the surface. The dressing element can, for example, act to sand, clean, polish, buff and the like, the surface. The apparatus is particularly effective when the dressing element comprises an abrasive element, e.g., sandpaper, effective to remove the top surface portion or surface finish from the surface being dressed.

The bearing means may be any suitable bearing subsystem capable of being press fitted into both the housing means and the disc means, and of functioning in the present apparatus. Preferably, the bearing means is press fitted into an indent which is part of the housing means, for example, located on the underside of bottom of the housing means. Preferably, the bearing means has a larger outside diameter than the diameter of the indent prior to the bearing means being press fitted into the indent. More preferably, the disc means includes a half donutshaped cavity into which the bearing means is press fitted. The bearing means may be a conventional ball-bearing subsystem. Preferably, the bearing means comprises a contained i.e., totally enclosed, self-lubricating bearing.

In general, and except as otherwise provided for herein, the apparatus of the present invention may be fabricated from any suitable material or combination of materials of construction. The material of construction used for each component of the present apparatus may be dependent upon the particular application involved. Of course, the apparatus should be made of material which are substantially unaffected, except for normal wear and tear, by the conditions at which the apparatus is normally operated. In addition, such material or combination of materials of construction should have no substantial detrimental effect on the surface, e.g., floor, being dressed.

These and other aspects and advantages of the present invention are set forth in the following detailed description and claims, particularly when considered in conjunction with the accompanying drawings in which like parts bear like reference numerals. In the drawings:

FIG. 1 is a top front view, in perspective, of one embodiment of the present apparatus.

FIG. 2 is an exploded top front view, in perspective, showing the embodiment of the present apparatus shown in FIG. 1.

FIG. 3 is a cross-section view taken along line 3—3 of FIG. 1.

Referring now to the drawings, a rotary sanding machine, shown generally at 10, includes a cast aluminum housing 12, a rotating disc 14, a thermally protected electric motor 16, casters 18 and 20, two hand grips 22 and 24, a totally enclosed self-lubricating bearing 26 and a belt 28.

FIG. 2 illustrates how these and other components are assembled to provide rotary sanding machine 10. One important feature is the unitized structure of housing 12, which is preferably cast as a single piece, as shown in the drawings. This construction of housing 12 allows for quick and easy assembly and maintenance of machine 10.

Motor 16 is mounted on housing 12 near the rear of housing 12 by bolts 30 and flat washers 32. Motor 16 includes four bolt receptacles 36 in which bolts 30 are received to secure motor 16 to housing 12. Motor 16 also includes a rotating power shaft 38 which rotates in response to the power or force generated by motor 16. Shaft 38 is fitted and secured in the central hole 39 of the pulley 40. A key 42 is used to insure that shaft 38 is secured in hole 39.

Belt 28 is wrapped around the base of pulley 40, and rotates in response to the rotation of pulley 40 to transfer force from motor 16 to disc 14, which is situated so that belt 28 is wrapped around the upper portion 44 of disc 14. Disc 14 rotates in response to the rotation of belt 28, thereby receiving at least a portion of the rotational force generated by motor 16.

Disc 14 includes a central upwardly extending, internally threaded peg 46. The front end 48 of housing 12 has a circular configuration. The underside of front end 48 includes a circular, downwardly extending projection 50 which forms a central, circular hole adapted and sized to receive peg 46 as shown in FIG. 2. Bearing 26 is also located in this central, circular hole in projection 50 and is press fitted into this hole between projection 50 and peg 46. This press fitting can be accomplished using an arbor press or like device. Preferably the diameter of bearing 26 is slightly larger, e.g., about 0.001 inch to about 0.01 inch and more preferably about 0.005 inch larger, than the diameter of the circular hole between peg 46 and projection 50 so that bearing 26 can be effectively press fitted and secured in this circular hole. This press fitting of bearing 26 effectively secures disc 14 to front end 48 of housing 12. Front end 48 also includes a through hole 51 which is aligned with, and of larger diameter than, the threaded hole in peg 46. A dust plug 52 is placed in hole 51 during the time machine 10 is being used. Dust plug can easily be removed, if desired, to facilitate maintenance on machine 10, for example, replacement of belt 28 and/or bearing 26.

A rubber mat 54 is adhesively secured to the underside of disc 14. A sandpaper element 56 is placed in contact with rubber mat 54 and is secured in place on disc 14 by threaded bolt 58 and cone washer 60. Threaded bolt 58 is sized to be received and secured by the internal threads of the central hole of peg 46. Also, peg 46, disc 14, mat 54, element 56, cone washer 60 and threaded bolt 58 are sized and structured so that threaded bolt 58 is recessed in relative to the flat contact surface of sandpaper element 56 so that threaded bolt 58 does not contact the surface, e.g., floor being sanded.

Casters 18 and 20 are secured to threaded shanks 60 and 62, respectively which pass through separate holes in housing 12, through lock nuts 64 and 66, respectively, and into thread protectors 68 and 70, respectively. The vertical distance between each of caster 18 and 20 and housing 12 can be independently adjusted by loosening lock nuts 64 and/or 66, as the case may be, adjusting the position of casters 18 and/or 20, as the case may be, and retightening lock nuts 64 and/or 66, as the case may be.

Hand grip mounts 72 and 74 are located at the rear end of, and are an integral part of, housing 12. Handle rods 76 and 78 are secured to mounts 72 and 74, respectively, by means of flat head screws 80, lock washers 82 and jam nuts 84. Hand grips 22 and 24 are slipped on handle rods 76 and 78, respectively. Hand grips 22 and 24 are located substantially adjacent to housing 12, approximately six inches above the underside of housing 12, and allow the human operator of machine 10 improved freedom to manuever machine 10 into hard-to-reach spots. Handle rods 76 and 78 may be removed from housing 12 and replaced, for example, by new or longer grips. This feature provides added flexibility to machine 10.

Electric motor 16 is equipped with an on/off switch 86 and a connector 88 which allows an electric cord 90 to provide electricity to motor 16 from a conventional power source (not shown). Switch 86 and cord 90 are not directly associated with hand grips 22 and 24. Thus, the human operator of machine 10 can easily avoid getting electric cord 90 wrapped around his/her arms.

Machine 10 functions very effectively as a rotary sander, e.g., for floors and the like. The relatively light weight and low profile of machine 10, particularly toward front end 48 of housing 12, allows effective sanding in hard-to-reach places, e.g., under heat radiators or other structures. The use of bearing 26 which is press fitted between front end 48 and disc 14 further enhances this low profile feature of machine 10. Adjustable casters 18 and 20 and removable handgrips 22 and 24 also add to the flexibility and versatility of machine 10. Ease of operation and maintenance are additional features of the present invention, exemplified by machine 10.

While this invention has been described with respect to various specific examples and embodiments, it is to be understood that the invention is not limited thereto and that it can be variously practiced within the scope of the following claims.

The embodiments of the present invention in which an exclusive property or privilege is claimed are as follows:

1. An apparatus useful for dressing a surface comprising:

housing means having mutually opposing first and second ends and, as an integral part of said housing means, two separate hard grip mounts;

motor means adapted to be mounted on said housing means;

disc means adapted to be located near said first end of said housing means and being capable of rotating relative to said housing means in response to the force generated by said motor means, said disc means including a dressing element adapted to contact said surface to provide the desired dressing to said surface;

force transfer means associated with both said motor means and said disc means and acting to transfer rotational force generated by said motor means to said disc means; and bearing means press fitted into said housing means and press fitted onto said disc means and acting to facilitate the rotation of said disc means relative to said housing means, said housing means including a hole therethrough to facilitate replacement of said bearing means.

2. The apparatus of claim 1 wherein said hand grip mounts are located at or near said second end of said housing means.

3. The apparatus of claim 1 which further comprises at least two casters located near said second end of said housing means, said casters being rotatable relative to said housing means and being capable of contacting said surface to facilitate the movement of said apparatus on said surface.

4. The apparatus of claim 3 wherein said casters are structured so that the position of said casters relative to said housing means is adjustable so that the distance between said second end of said housing means and said surface when said casters contact said surface is adjustable.

5. The apparatus of claim 1 wherein said motor means is structured to be powered by electricity.

6. The apparatus of claim 1 wherein said disc means includes a disc and said dressing element is removably mounted on said disc.

7. The apparatus of claim 6 said disc means further includes a traction layer mounted on said disc and contacting said dressing element.

8. The apparatus of claim 6 wherein said dressing element is threadably mounted on said disc.

9. The apparatus of claim 1 wherein said dressing element comprises an abrasive element.

10. The apparatus of claim 6 wherein said dressing element comprises an abrasive element.

11. The apparatus of claim 1 wherein said force transfer means comprises a continuous belt.

12. The apparatus of claim 1 wherein said bearing means is press fitted into an indent which is part of said housing means.

13. The apparatus of claim 12 wherein said bearing means has a larger outside diameter than the diameter of said indent prior to said bearing means being press fitted into said indent.

14. The apparatus of claim 13 wherein said bearing means comprises a contained, self-lubricating bearing.

15. In a surface dressing machine including housing means, motor means mounted on said housing means, disc means associated with said housing means and being capable of rotating relative to said housing means in response to the force generated by said motor means, the improvement which comprises: bearing means press fitted onto said housing means and press fitted onto said disc means relative to said housing means; and said housing means includes a hole therethrough to facilitate replacement of said bearing means and as an integral part thereof, two separate hand grip mounts.

16. The apparatus of claim 15 wherein said bearing means is press fitted into an indent which is part of said housing means.

17. The apparatus of claim 16 wherein said bearing means has a larger outside diameter than the diameter of said indent prior to said bearing means being press fitted into said indent.

18. The apparatus of claim 15 wherein said bearing means comprises a contained, self-lubricating bearing.

19. The apparatus of claim 17 wherein said bearing means comprises a contained, self-lubricating bearing.

* * * * *